US006609896B2

(12) United States Patent
Hix et al.

(10) Patent No.: US 6,609,896 B2
(45) Date of Patent: Aug. 26, 2003

(54) DEVICE AND METHOD FOR REDUCING FORCES IN MECHANISMS

(75) Inventors: Scott G. Hix, Bristol, VA (US); John R. Walters, Jr., Abingdon, VA (US); David T. Monk, Bristol, VA (US); Tyrone S. Simerly, Johnson City, TN (US)

(73) Assignee: Bristol Compressors, Inc., Bristol, VA (US)

( * ) Notice: Subject to any disclaimer, the term of this patent is extended or adjusted under 35 U.S.C. 154(b) by 6 days.

(21) Appl. No.: 10/055,965

(22) Filed: Jan. 28, 2002

(65) Prior Publication Data

US 2003/0143083 A1 Jul. 31, 2003

(51) Int. Cl.[7] ..... F04B 1/00; F04B 17/00

(52) U.S. Cl. ..... 417/221; 417/410.1; 417/415; 417/902; 92/129

(58) Field of Search ..... 417/221, 410.1, 417/415, 902, 437; 92/129

(56) References Cited

U.S. PATENT DOCUMENTS

| | | | | | |
|---|---|---|---|---|---|
| 3,584,423 | A | | 6/1971 | Hoare | 51/105 |
| 4,105,375 | A | | 8/1978 | Schindelhauer | 418/54 |
| 4,332,163 | A | * | 6/1982 | Emerson | 73/119 A |
| RE31,947 | E | | 7/1985 | Farr | 417/313 |
| 4,892,467 | A | | 1/1990 | Crofoot | 417/353 |
| 4,998,864 | A | | 3/1991 | Muir | 417/410 |
| 5,064,356 | A | | 11/1991 | Horn | 417/410 |
| 5,498,143 | A | | 3/1996 | Dreiman et al. | 418/55.1 |
| 5,784,927 | A | | 7/1998 | Rao et al. | 74/573 R |
| 6,092,993 | A | * | 7/2000 | Young et al. | 417/53 |
| 6,132,177 | A | * | 10/2000 | Loprete et al. | 417/221 |
| 6,446,451 | B1 | * | 9/2002 | Monk et al. | 62/228.5 |

FOREIGN PATENT DOCUMENTS

| | | | | |
|---|---|---|---|---|
| JP | 62-35130 | * | 2/1987 | 188/322.5 |
| JP | 10-252647 | * | 9/1998 | |

OTHER PUBLICATIONS

J. Walters, *A Computational Mode of Impact Loading in a Modulating Reciprocating Compressor*, Prepared for 2000 International Compressor Engineering Conference, 7–2000.

* cited by examiner

*Primary Examiner*—Charles G. Freay
*Assistant Examiner*—Michael K. Gray
(74) *Attorney, Agent, or Firm*—Finnegan, Henderson, Farabow, Garrett & Dunner, LLP

(57) ABSTRACT

The reliability of a compressor may be improved by affixing an inertia-increasing member to the drive shaft of the compressor in order to reduce the forces imposed on a mechanical coupling between the drive shaft and a compression member when the rotation of the drive shaft is initiated. A method of selecting the size and configuration of the inertia-increasing member is also provided.

25 Claims, 8 Drawing Sheets

DEVICE AND METHOD FOR REDUCING FORCES IN MECHANISMS

BACKGROUND OF THE INVENTION

The present invention relates generally to a compressor for use in a heating, ventilating and air conditioning system. More particularly, the present invention relates to a device and method for improving the operation of compressors used in heating, ventilating, and air conditioning systems.

In order to increase the efficiency of heating, ventilating, and air conditioning (HVAC) systems, modulating compressors have been developed. Modulating compressors allow a variation in capacity of the output of the compressor, thereby allowing HVAC systems to operate more efficiently. Some examples of modulating compressors include, but are not limited to, two-speed compressors, hot gas bypass compressors, variable speed compressors, and blocked or open suction-type compressors.

The cylinder disengagement-type compressor is known to be a particularly versatile and efficient type of modulating compressor. Reference is made to U.S. Pat. No. 6,132,177, for a more detailed understanding of cylinder-disengagement type compressors, the disclosure of which is incorporated by reference. Such a compressor operates by selectively deactivating one or more cylinders of a reciprocating compressor. In a cylinder disengagement-type compressor, a drive motor of the compressor is reversible. By reversing the motor, the capacity of one or more of the cylinders of a reciprocating compressor may be varied. This variation in capacity may be achieved by the operation of an eccentric cam on a crankpin of a compressor crankshaft. By rotating the eccentric cam in either direction relative to the crankshaft, a variation in the effective stroke length of the piston may be achieved. This variation in the stroke length yields a variation in the capacity of the affected cylinder of the compressor. As a result, the cylinder disengagement-type compressor can be extremely efficient and provide a very cost-effective way to achieve capacity modulation.

For HVAC systems requiring compressors having larger capacities such as 3–5 tons, the use of more powerful, three-phase motors for example, may be desired. Three-phase motors may often have a start-up torque having a magnitude significantly higher, often as much as three to five times higher, than the steady-state torque required to operate a compressor of a given capacity. Due to this excessive start-up torque, the angular acceleration of the crankshaft of the compressor may also be correspondingly excessive. As a result, when the three-phase motor of a cylinder disengagement-type compressor is reversed, the crankpin rotates through an arc in an unloaded condition and strikes the eccentric cam, thereby exerting a significant impact force between the crankpin and the eccentric cam. Repeated occurrences of such impact forces may reduce the reliability of the cylinder disengagement-type compressor resulting in costly maintenance and repairs. The theoretical relationship between the impact force and the crankshaft/rotor inertia in such a system is described in "A Computational Model of Impact Loading in a Modulating Reciprocating Compressor," distributed in the August 2000 International Compressor Engineering Conference.

SUMMARY OF THE INVENTION

Accordingly, the present invention is directed to a device and method for reducing the impact force of a crankpin on an eccentric ring when a motor of a cylinder disengagement-type compressor is reversed. The devices and methods of the present invention reduce the impact force of the crankpin against the eccentric cam by increasing the rotational inertia of the crankshaft. Increasing the inertia of the crankshaft reduces the angular acceleration of the crankshaft, thus reducing the velocity of the crankpin as it rotates to the point of impact. Since the velocity and acceleration at the point of impact is reduced, the impact force is reduced.

At the same time, increasing the rotational inertia of the crankshaft too much can impose substantial and damaging forces on the motor mounts. The present invention preferably increases the rotational inertia of the crankshaft to a degree that increases the service life of the mechanical coupling between the crankshaft and the compressing member of the compressor, while keeping the service life of the motor mounts within an acceptable limit. Most preferably, the service life of the mechanical coupling, the motor mounts, and other service components of the compressor will all fall within an optimum service life.

The advantages and purposes of the invention will be set forth in part in the description which follows, and in part will be obvious from the description, or may be learned by practice of the invention. The advantages and purposes of the invention will be realized and attained by the elements and combinations particularly To attain the advantages and in accordance with the purposes of the invention as embodied and broadly described herein, one aspect of the invention is directed to a variable capacity or modulating compressor for use in an HVAC system including a block defining at least one cylinder, a reversible drive shaft rotatably supported by the block, and a piston coupled to the reversible drive shaft for compressing a fluid within the cylinder. The variable capacity or modulating compressor further includes a motor added to the reversible drive shaft for rotating the reversible drive shaft, an inertia-increasing member coupled to the reversible drive shaft for reducing the acceleration of the reversible drive shaft, and a housing containing the block, the reversible drive shaft, the piston, the motor, and the inertia-increasing member, whereby the capacity of the compressor is changed upon reversal of the direction of rotation of the reversible drive shaft.

In yet another aspect, the invention provides a reciprocating drive system including a reversible drive shaft, a motor coupled to the reversible drive shaft for rotating the reversible drive shaft, and a reciprocating member coupled to the reversible drive shaft for providing a reciprocating linear displacement. The reciprocating drive system further includes a cam member coupled to the reversible drive shaft, an eccentric member coupling the cam member to the reciprocating member, and an inertia-increasing member on the drive shaft for reducing the acceleration of the reversible drive shaft, whereby the cam member and eccentric member are configured to alter the reciprocating linear displacement of the reciprocating member upon reversal of the direction of rotation of the reversible drive shaft.

In a further aspect, the invention provides a method for reducing an impact force between components in a cylinder disengagement-type compressor including a block defining at least one cylinder, a reversible drive shaft rotatably supported by the block, a piston coupled to the drive shaft for compressing a fluid within the cylinder, a motor coupled to the reversible drive shaft for rotating the reversible drive shaft, and a housing containing the block, the reversible drive shaft, the piston, and the motor, whereby the capacity of the cylinder disengagement-type compressor is changed upon reversal of the direction of rotation of the reversible drive shaft. The method includes increasing the inertia of the reversible drive shaft by including an inertia-increasing member to the reversible drive shaft, said inertia-increasing member being sized to reduce to a safe level the acceleration of the reversible drive shaft upon start-up or reversal of the direction of rotation of the reversible drive shaft.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE EMBODIMENTS

Figure 1:
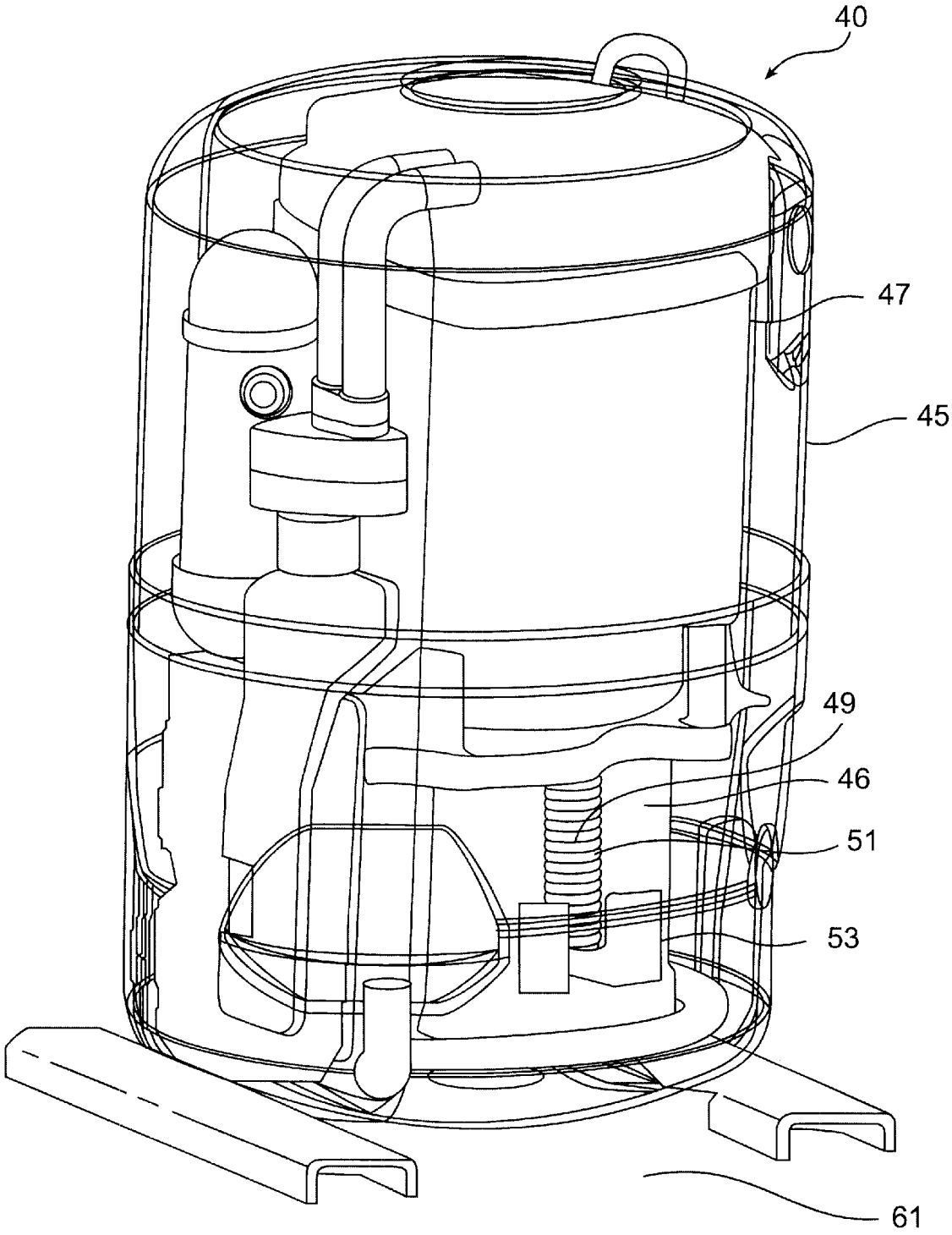
FIG. 1 is a perspective view of a compressor according to one aspect of the invention.

Reference will now be made in detail to the present embodiments of the invention, examples of which are illustrated in the accompanying drawings. Wherever possible, the same reference numbers will be used throughout the drawings to refer to the same or like parts.

In one embodiment, a cylinder disengagement-type compressor is provided. This embodiment contemplates use of an inertia-increasing member in order to improve the reliability of the compressor. The inertia-increasing member is affixed to the crankshaft of the compressor to reduce the impact force between a crankpin and an eccentric member when the direction of rotation of the motor is reversed.

Modulating compressors have been found to greatly enhance the efficiency and dependability of HVAC systems. A cost-effective and reliable type of modulating compressor is the cylinder disengagement-type compressor. A cylinder disengagement-type compressor may include at least one eccentric cam that alters the stroke length of at least one piston when the motor rotation is reversed. Such compressors may include a single compression chamber and piston, or multiple compression chambers and pistons. If the cylinder disengagement-type compressor is a single piston compressor, the piston may travel through a full stroke length when the crankshaft is rotated in one direction and a reduced stroke length when the rotation of the crankshaft is reversed. The maximum stroke lengths of different pistons in a multi-piston compressor may be either the same or varied to provide optimum capacity for a specific application. The minimum stroke length of a given piston driven by an eccentric, two-position cam may be varied from zero length to a length slightly less than full length. The desired stroke lengths may be achieved by the eccentricities of the crankshaft, or the combination of the eccentricities of the crankshaft and the eccentric cams driving the respective pistons.

For example, a compressor may have two cylinders, one of which having variable stroke length capability achieved through the use of an eccentric cam. In such a cylinder, the piston driven by the eccentric cam may have zero stroke length when the eccentric cam is in a first position, and a full stroke length when the eccentric cam is in a second position. The eccentric cam may also be configured to provide the one piston with a reduced stroke length instead of zero stroke length. This results in an infinite number of capacities for the cylinder disengagement-type compressor. As a result, the designer may optimize the capacity of such a cylinder disengagement-type compressor to meet the particular demands of a given application.

In addition to a two-cylinder application, the cylinder disengagement principle may be applied to either single or other multiple cylinder applications, such as, but not limited to, compressors having three and four cylinders. This results in an ability to design a wide variety of capacities to meet many varied compressor requirements.

Figure 2:
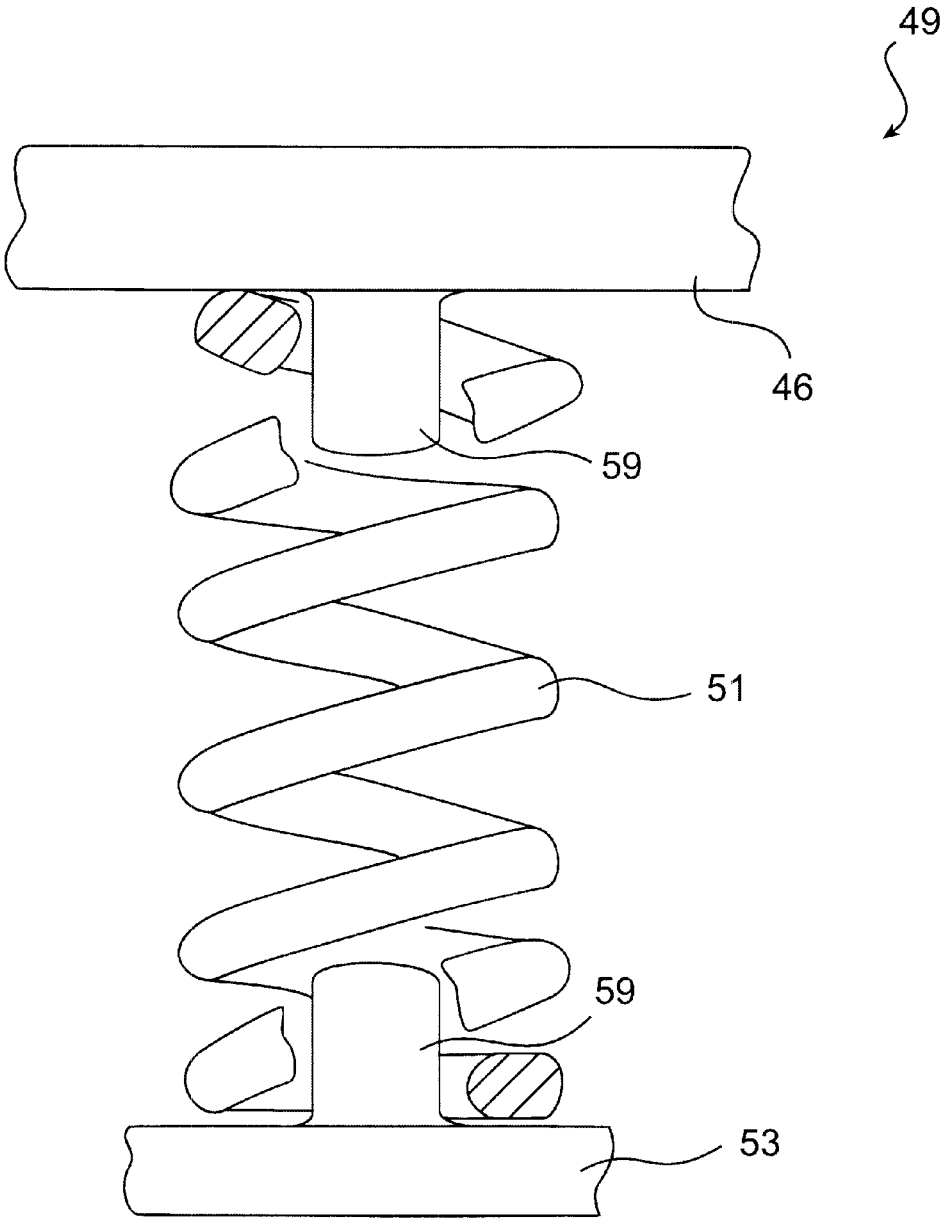
FIG. 2 is a schematic partial cross-sectional view of a compressor mount according to one aspect of the invention.

FIG. 1 depicts a compressor 40 having a housing 45, a cylinder block 46, and a motor 47 according to one aspect of the invention. The cylinder block 46 and the motor 47 are assembled and installed in the housing 45 and supported by two compressor mounts 49 located on substantially opposite sides of the housing 45. Although this example provides two compressor mounts, it is contemplated that a number of compressor mounts other than two, such as one, three, or four, could be used. The compressor mounts 49 each include a spring 51 interconnecting the cylinder block 46, and a bracket member 53. The bracket member 53 is fixed to the housing 45 by resistance welding, for example, although the use of alternative fastening means such as threaded fasteners or rivets is contemplated. As shown schematically in FIG. 2, for example, locator studs 59 on the bracket member 53 and the cylinder block 46 align the spring 51, which extends between the bracket member 53 and the cylinder block 46. According to this arrangement, the cylinder block 46 and the motor 47 are supported within the housing 45 in a manner that substantially isolates any vibration due to operation of the compressor 40 from the surface 61 that supports the compressor 40.

Figure 3:
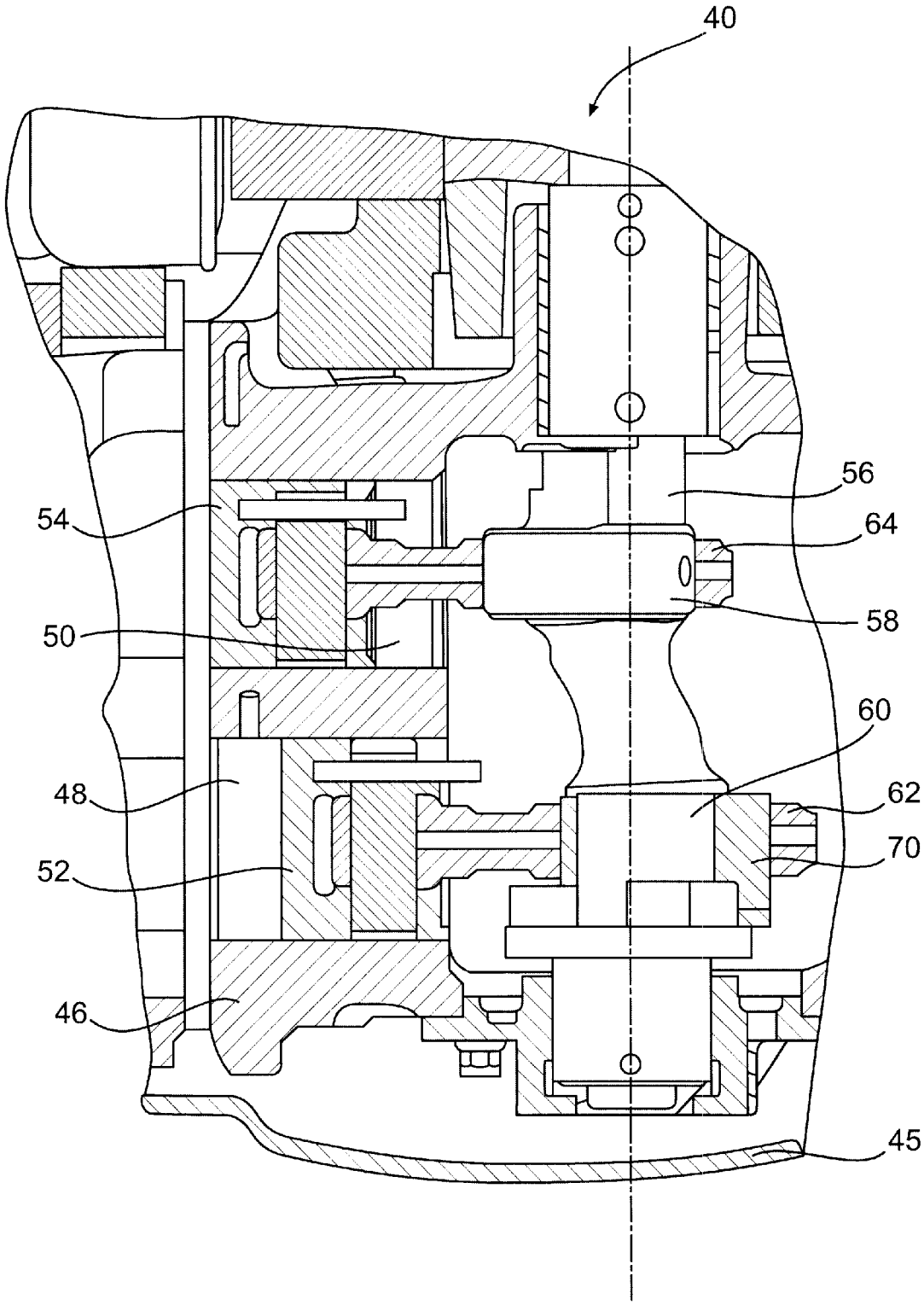
FIG. 3 is a longitudinal, partial, vertical cross-sectional view of a compressor according to one aspect of the invention.

FIG. 3 depicts a variable-capacity compressor 40 having dual in-line cylinders 42 and 44. The compressor 40 includes a housing 45, a cylinder block 46 formed with cylinders 48 and 50 in which pistons 52 and 54 are mounted. A crankshaft 56 is rotatably mounted in block 46 and is provided with eccentric crankpins 58 and 60. Connecting rods 62 and 64 are provided on the crankshaft 56. An eccentric cam 70 is rotatably mounted on at least one of the crankpins 58 and/or 60.

Figure 4:
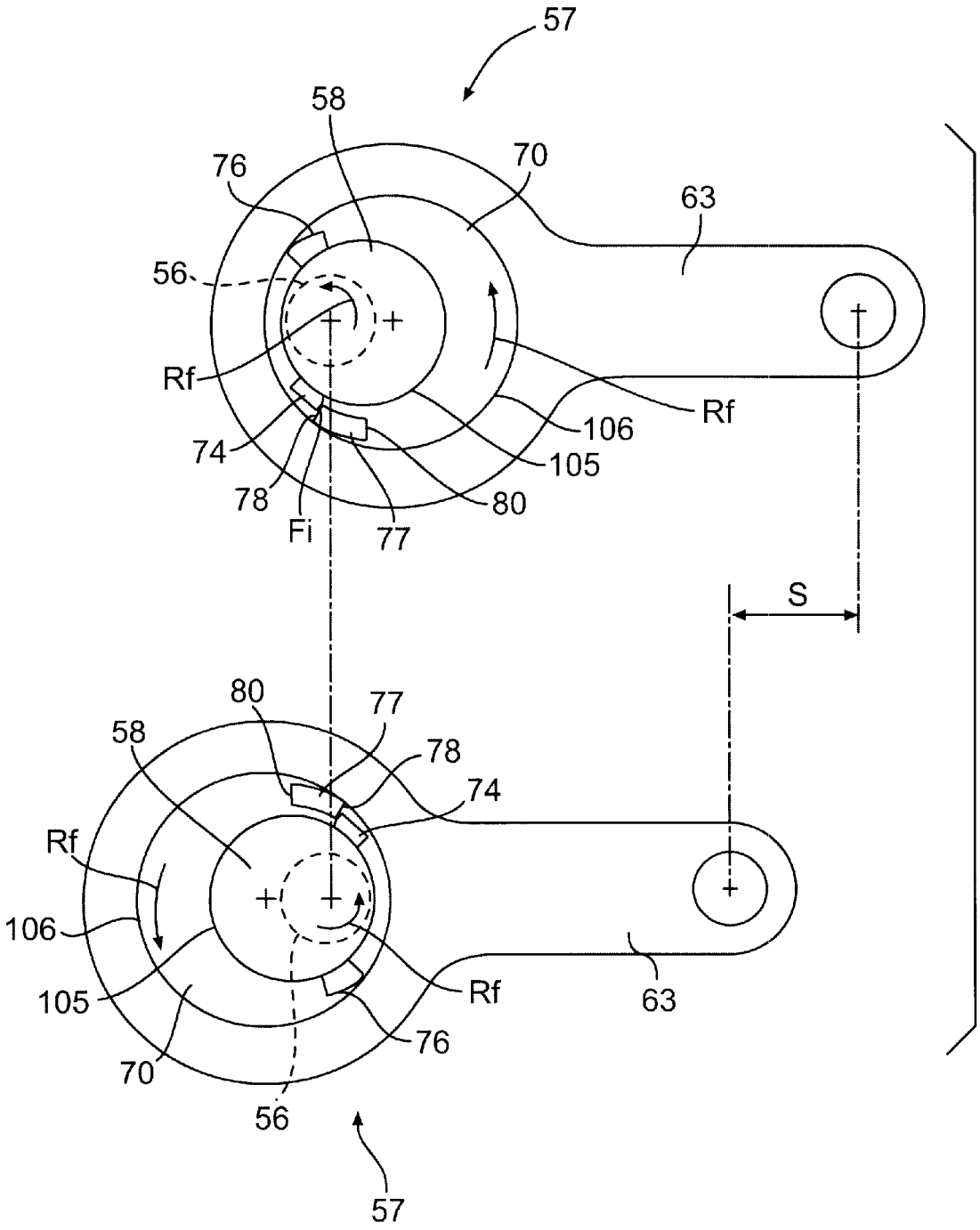
FIG. 4 is a schematic diagram of a crankshaft and eccentric cam assembly in a configuration in which a cylinder is engaged according to one aspect of the invention.

FIG. 4 is a schematic diagram of a configuration in which a cylinder is engaged such that rotation of the crankshaft 56 results in a stroke length S of the connecting rod 63 and piston, not shown. A crankshaft assembly 57 includes crankpin 58, including two lands 74 and 76, and an eccentric cam 70 including an extension 77 that provides two stops 78 and 80 to engage the respective lands 74 and 76 of the crankpin 58 as the crankshaft 56 rotates as a result of operation of a motor, not shown. The eccentric cam 70 fits over the crankshaft 56 such that the lands, 74 and 76, and stops, 78 and 80, are aligned and abut one another during the operation of the compressor 40.

When the cylinder is in an engaged configuration as shown in FIG. 4, the crankshaft 56 is driven by a motor, not shown, and rotates in a first direction $R_f$. As the crankshaft 56 rotates in the first direction $R_f$, the crankpin 58 rotates within the eccentric cam 70 on bearing surface 105 until the land 74 of the crankpin 58 abuts the stop 78 of the eccentric cam 70. Once the land 74 abuts the stop 78, the eccentric cam 70 rotates in the first direction $R_f$ with the crankpin 58 as shown. In this position, the eccentric cam 70 is configured such that its external bearing surface 106 provides an eccentric motion. A connecting rod 63 rides on the external bearing surface 106 resulting in a linear reciprocating stroke length S of a piston, not shown.

Figure 5:
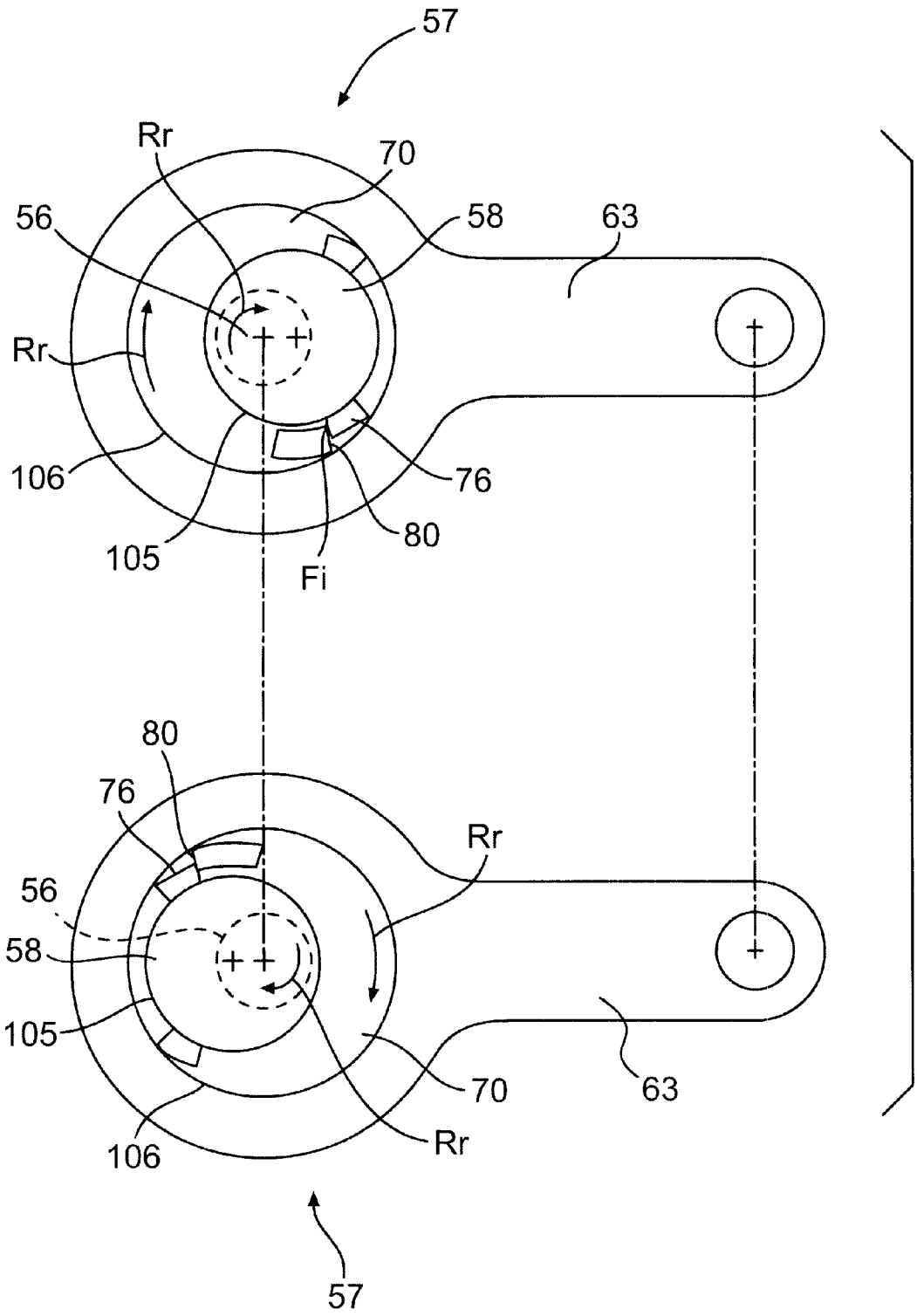
FIG. 5 is a schematic diagram of a crankshaft and eccentric cam assembly in a configuration in which a cylinder is disengaged according to one aspect of the invention.

In order to alter the capacity of the compressor 40, the first direction of rotation $R_f$ of the motor is reversed such as shown in FIG. 4. FIG. 5 shows the eccentric cam 70 in engagement with the crankpin 58 in a configuration resulting in the disengagement of the cylinder. When the motor is reversed, the first direction of rotation $R_f$ of the crankshaft 56 reverses, becoming a second direction of rotation $R_r$. As the crankshaft 56 reverses direction, the crankpin 58 rotates within the eccentric cam 70 on the bearing surface 105 until the land 76 abuts the stop 80. Once the land 76 abuts the stop 80, the eccentric cam 70 rotates in the second direction $R_r$ with the crankpin 58 as shown. The eccentric cam 70 may be configured such that its external bearing surface 106 rotates concentrically with the crankshaft 56 resulting in zero linear reciprocating stroke length S of the piston. Alternatively, instead of completely negating the linear reciprocating stroke length S of the piston as shown in FIG. 5, the eccentric cam may be configured to merely reduce the stroke length S.

In HVAC applications requiring compressor systems having larger capacities such as three to six ton compressors, it may often be desirable to use more powerful three-phase electric motors to drive the compressor systems. A characteristic inherent to many three-phase motors is a relatively high start-up torque. Often, the start-up torque of a three-phase motor may be as much as three to five times as high as the steady-state operating torque, the torque required to drive the a given compressor system at a relatively constant output. Therefore, although the three-phase motor may be properly selected based upon the steady-state torque, the start-up torque may in fact be substantially excessive.

As a result of the excessive start-up torque that may be encountered with a three-phase motor of larger capacity compressor systems, problems may occur during the operation of a conventional cylinder disengagement-type compressor. Such problems may be experienced when the direction of the motor is reversed and the crankpin 58 rotates through an arc in an unloaded condition and strikes one of the stops 78 or 80 of the eccentric cam 70, thereby exerting an impact force $F_i$ on the stop. Because the torque of the motor must be relatively high in order to be sufficient to drive the compressor 40 at maximum capacity, a large impact force $F_i$ is generated between the lands 74 and 76 of the crankpin 58 and the stops 78 and 80 of the eccentric cam 70 when the motor is reversed. Repeated occurrences of this impact force $F_i$ may reduce the reliability of the conventional cylinder disengagement-type compressor.

The magnitude of the resulting impact force $F_i$ between the lands 74 and 76 of the crankpin 58 and the stops 78 and 80 of the eccentric cam 70 upon reversal of the motor varies directly with the magnitude of the angular acceleration of the crankpin 58. The magnitude of this acceleration is, in turn, directly proportional to the torque applied by the motor divided by the value of the inertia of the components rotated by the motor. As stated previously, in a situation in which a three-phase motor is being used to drive compressor systems having a larger capacity, the magnitude of the start-up torque may be as much as three to five times higher than the steady-state torque required to drive the compressor system once running at a relatively constant output. As a result, the magnitude of the impact force $F_i$ may be excessively high, sometimes destructively high.

Therefore, in accordance with the present invention, the magnitude of the impact force $F_i$ is reduced by increasing the rotational inertia of the components rotated. As a result, the impact force $F_i$ between the lands 74 and 76 of the crankpin 58 and the stops 78 and 80 of the eccentric cam 70 is reduced by an amount sufficient to substantially eliminate the problem of impact on drive shaft reversal in conventional cylinder disengagement-type compressors.

Figure 6:
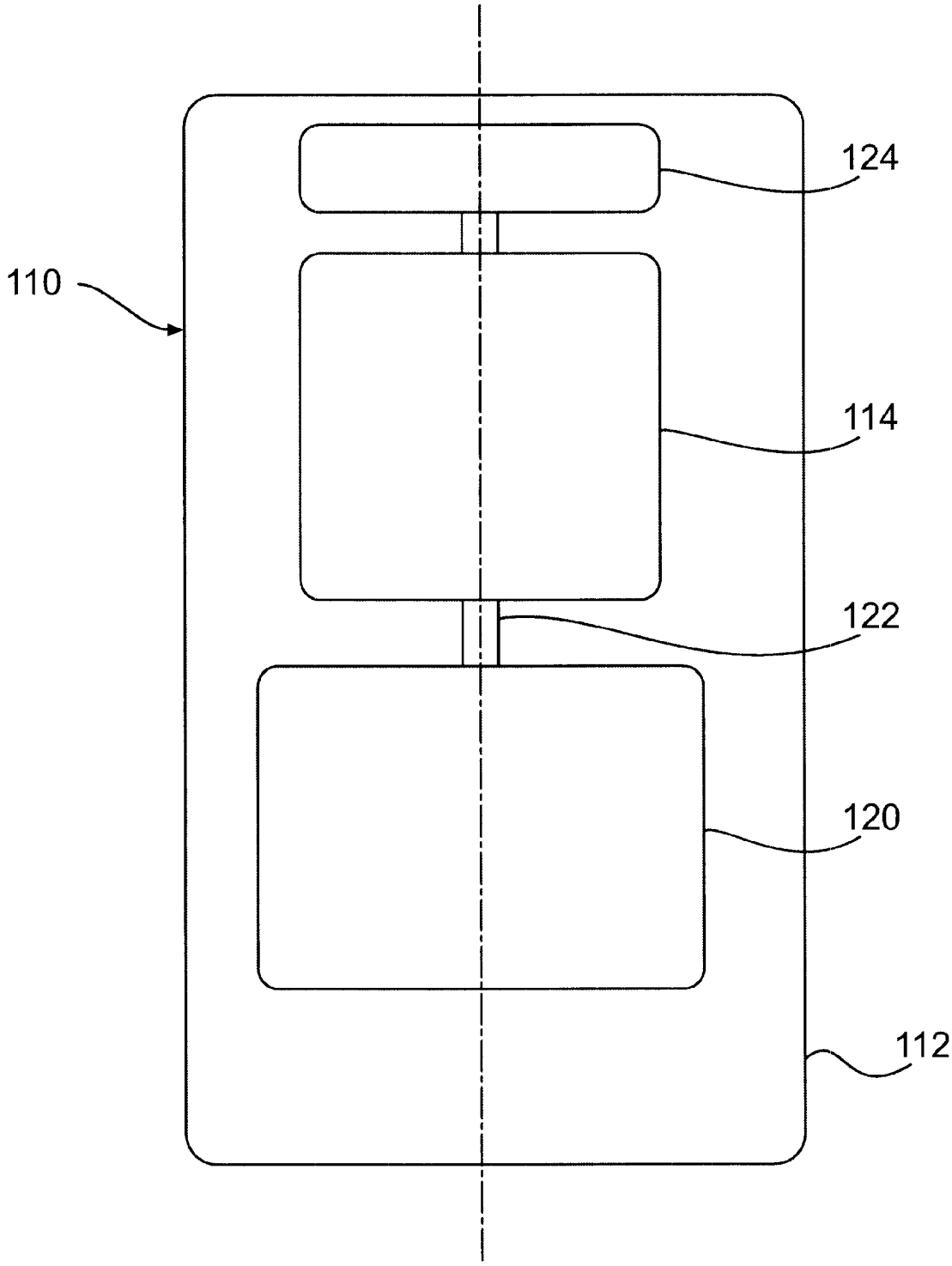
FIG. 6 is a schematic diagram of one embodiment of a compressor system according to one aspect of the invention.

FIG. 6 is a schematic diagram of one embodiment of a compressor system 110 according to one aspect of the invention. In such a compressor system 110, a housing 112 contains a motor 114, connected to a compressor block 120 by a drive shaft 122. On an upper end of the drive shaft 122, for example, is an inertia-increasing device such as a flywheel 124 or a similar mass added to the conventional crankshaft or motor rotor. It is noted that while the flywheel 124 (or other added mass) in this embodiment is shown at the upper end of the compressor system 110, the flywheel 124 could be equally effective in other positions so long as it is located in a position that will result in an increased rotational inertia of the parts rotated during reversal and/or operation of the drive shaft 122. Although the flywheel 124 is illustrated as an example of the invention, any structure that would increase the rotational inertia of the rotating components of the compressor system 110 during reversal and/or operation of the drive shaft 122 would follow the principles of this invention.

Several practical considerations arise when designing a flywheel for a compressor system. First, in order to prevent possible additional costs associated with designing and manufacturing a new compressor system, the flywheel or added mass may be designed such that it can be incorporated into an existing compressor system. This prevents the redesign and manufacture of at least a new housing and crankshaft parts. Second, the size and configuration of the flywheel preferably is designed to optimize the service life of the compressor.

As the rotational inertia of the crankshaft is increased, the service life of other components of the compressor system may be reduced. For example, during a test, a prototype cylinder disengagement-type compressor driven by a three-phase motor was fitted with a flywheel having a mass X. This test was conducted in order to determine the service life of the crankshaft assembly. While the test results confirmed that fitting a flywheel having a mass X to the crankshaft of the compressor system increased the operating life of the crankshaft assembly, the test also revealed that the service life of the compressor mounts was reduced. Therefore, the benefit achieved by simply fitting a flywheel to the crankshaft may be lost if the flywheel reduces the service life of the compressor mounts below the new service life of the mechanical linkage between the crankshaft and the compressor member (e.g. a piston) of the compressor. Therefore, the size and mass of the flywheel, or similar inertia-increasing member, must be optimized to provide an increased service life of all components of the compressor.

A theoretical explanation for the reduced service life of the compressor mounts suggests that the increased torque required to initiate rotation of the crankshaft assembly and flywheel transmits a reciprocal increase in torque that is thereby transferred to the compressor mounts. Since the service life of the compressor system is constrained by the component or system having the shortest service life, an optimum design may be achieved through selecting a mass and shape for the inertia-increasing member that will provide a compressor with an extended service life. For example, an optimum service life may be achieved by equalizing the service life of the crankshaft assembly with the service life of the compressor mounts as a function of the rotational inertia of the crankshaft. This suggests that an optimum inertia may be found through analytical modeling or through experimentation, or the combination of both, so that the service life of the crankshaft assembly and the service life of the compressor mounts both fall within an acceptable, improved service life. Preferably, the service life of both will be approximately equal.

For example, in a second test, a cylinder disengagement-type compressor driven by three-phase motor was fitted with a flywheel having a mass Y, reduced from mass X of the first test. An evaluation of the data from the second test revealed that reducing the mass of the flywheel in comparison with the mass of the flywheel in the first test resulted in a crankshaft assembly service life slightly reduced from the results of the first test but higher than the conventional compressor. However, the service life of the compressor mounts was increased to approximately match the service life of the crankshaft assembly. Comparing this data to that obtained in the first test showed that the service lives of the crankshaft assembly and the compressor mounts may be substantially equalized by selecting the optimum increase in rotational inertia for the crankshaft. This illustrates that the mass and shape of the inertia-increasing member may be selected to provide a compressor with an acceptable service life. Thus, by careful experimentation, an optimum value for rotational inertia of the flywheel may be obtained in order to maximize the service life of the compressor system as a whole.

Figure 7:
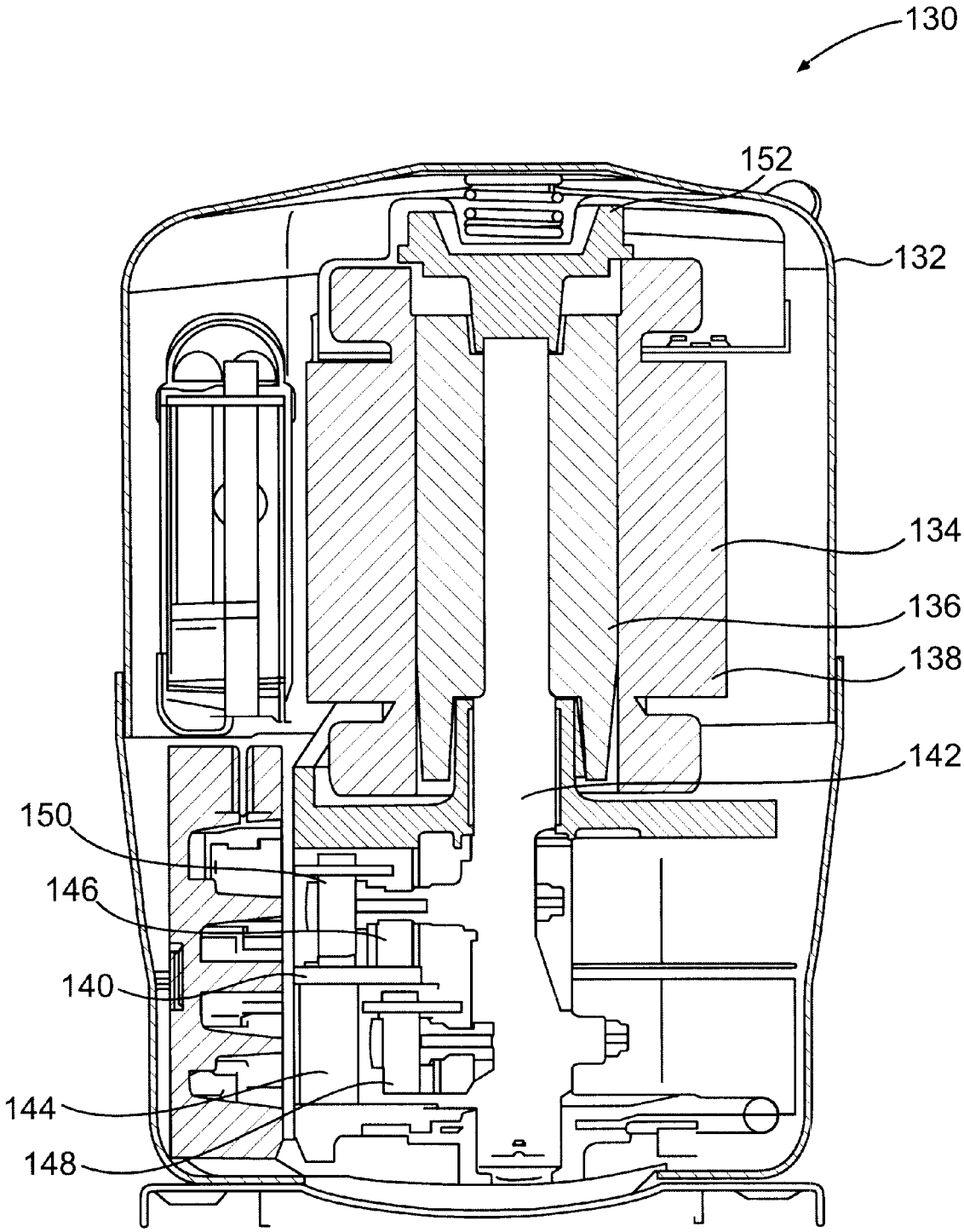
FIG. 7 is a section view of another embodiment of a compressor assembly according to another aspect of the invention.

FIG. 7 shows another embodiment of a compressor system 130 according to another aspect of the invention. In such a compressor system 130 housing 132 contains a motor 134 including a rotor 136 and stator 138, connected to the compressor block 140 by a drive shaft 142. The compressor block 140 houses cylinders 144 and 146 containing pistons 148 and 150, respectively. On an upper end of drive shaft 142, for example, is an inertia-increasing device such as a flywheel 152. It is noted that while the flywheel 152 in this embodiment is shown at the upper end of the compressor system 130, such a flywheel 152 could be equally effective in other positions so long as it is located in a position that will result in an increased rotational inertia of the parts rotated during reversal and/or operation of the compressor system 130. Further, although a flywheel 152 is provided as an example of the invention, any structure that would increase the inertia of the rotating components of the compressor system 130 during reversal and/or operation of the compressor system 130 would follow the principles of this invention.

Figure 10:
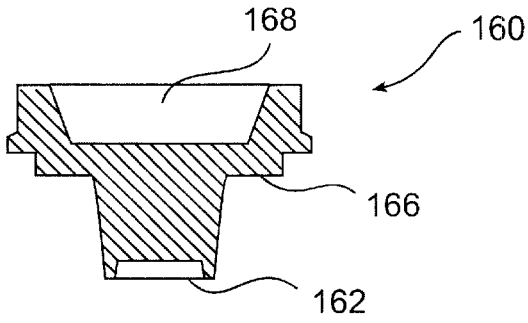
FIG. 10 is a section view of the embodiment shown in FIG. 8.
Figure 9:
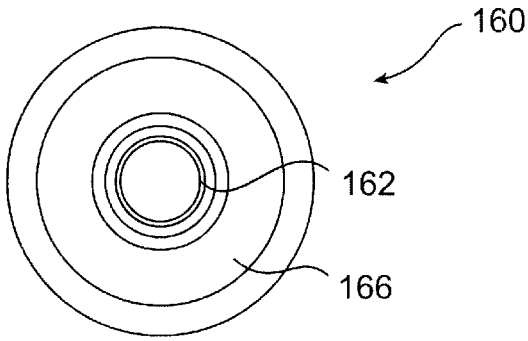
FIG. 9 is a front view of the embodiment shown in FIG. 8.
Figure 8:
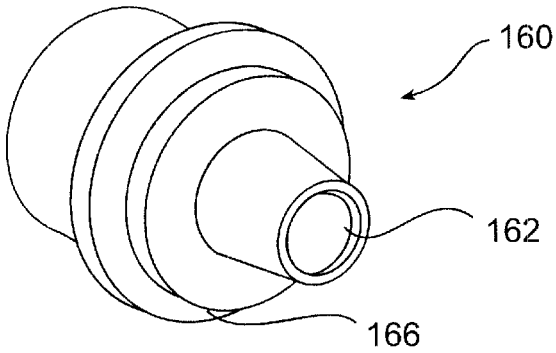
FIG. 8 is a perspective view of one embodiment of an inertia increasing member according to one aspect of the invention.

FIGS. 8–10 show one embodiment of an inertia-increasing member according to one aspect of the invention. An inertia-increasing member is provided in the form of a radially symmetric flywheel 160. The flywheel 160 includes an attachment portion 162 for attaching the flywheel 160 to a drive shaft, not shown. The attachment portion 162 may be a recess although it is contemplated that various optional structures for connecting the flywheel 160 to the drive shaft may be used, such as, but not limited to, a bore through the flywheel 160, a separate collar, a planar surface, and/or any other configuration aiding the attachment of the flywheel 160 to the drive shaft. Many types of attachment means may be used either singly, or in combination, and such attachment means include, but are not limited to, welding, adhesives, press-fitting, set screws, mounting bolts, mounting screws, and/or any other attachment means effectively attaching an inertia-increasing member to a shaft. Further, the flywheel 160 may also have a recess 168 for providing clearance between the flywheel and the compressor housing. An optional profile 166 may extend between the attachment portion 162 and the recess 168 for providing clearance between the flywheel 160 and the other portions of a compressor assembly such as shown in FIG. 7. The flywheel 160 may also have alternative configurations not shown that reduce the weight of the flywheel while maintaining a similar effective increase in the rotational inertia of the drive shaft. Such alternative configurations may include, but are not limited to, a spoked-configuration, and/or a configuration using multiple parts and/or materials. Additionally, the flywheel 160 may formed from numerous materials including, but not limited to, metals, plastics, wood-containing materials, composites, ceramics, glass, and/or any other suitable materials.

Although embodiments of the invention have been described extensively using a cylinder disengagement-type compressor as an example, the inertia-increasing member may also be used with other types of devices including, but not limited to, externally driven compressors, rotary compressors, scroll compressors, screw compressors, centrifugal compressors, or any other device having a mechanical coupling between the drive shaft and the compression member of the compressor that could benefit from an effective increase in the inertia of a drive shaft. Such benefits may include, but are not be limited to, minimizing the forces imposed on a mechanical coupling between a drive shaft and a driven member when the rotation of the drive shaft is initiated.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A compressor for use in an HVAC system, the compressor comprising:

a block defining at least one compression chamber;

a drive shaft rotatably supported by the block;

a compression member for compressing a fluid within the compression chamber, said compression member coupled to said drive shaft through a mechanical coupling;

a motor coupled to the drive shaft for rotating the drive shaft;

an inertia-increasing member added to the drive shaft that reduces the acceleration of the drive shaft as the motor initiates the rotation of the drive shaft in one or more directions and adds to the service life of the mechanical coupling; and a housing containing the block, the drive shaft, the compression member, the motor, and the inertia-increasing member, wherein the forces imposed on the mechanical coupling are minimized when the motor initiates rotation of the drive shaft.

2. The compressor of claim 1, wherein the mechanical coupling comprises:

a cam member on the drive shaft for creating a reciprocating linear displacement of the compression member within the compression chamber; and an eccentric member coupled to the cam member for altering the reciprocating linear displacement of the compression member within the compression chamber, wherein the eccentric member is configured to alter the reciprocating linear displacement of the compression member upon reversal of the direction of rotation of the drive shaft.

3. The modulating compressor of claim 1, wherein the inertia-increasing member comprises a flywheel fixed to an end of the drive shaft.

4. The modulating compressor of claim 3, wherein the flywheel is configured to provide clearance between the housing and the flywheel.

5. A modulating compressor for use in an HVAC system, the modulating compressor comprising:

a block defining at least one cylinder;

a reversible drive shaft rotatably supported by the block;

a piston, coupled to the reversible drive shaft through a mechanical coupling, for compressing a fluid within the cylinder;

a motor coupled to the reversible drive shaft for rotating the drive shaft;

an inertia-increasing member added to the reversible drive shaft that reduces the acceleration of the reversible drive shaft as the motor initiates the rotation of the drive shaft in one or more directions and adds to the service life of the mechanical coupling; and a housing containing the block, the reversible drive shaft, the piston, the motor, and the inertia-increasing member, wherein the capacity of the modulating compressor is changed upon reversal of the direction of rotation of the reversible drive shaft.

6. The modulating compressor of claim 5, wherein the mechanical coupling comprises:

a cam member on the drive shaft for creating a reciprocating linear displacement of the piston within the cylinder; and an eccentric member coupled to the cam member for altering the reciprocating linear displacement of the piston within the cylinder, wherein the eccentric member is configured to alter the reciprocating linear displacement of the piston upon reversal of the direction of rotation of the reversible drive shaft.

7. The modulating compressor of claim 5, wherein the inertia-increasing member comprises a flywheel fixed to an end of the reversible drive shaft.

8. The modulating compressor of claim 7, wherein the flywheel is configured to provide clearance between the housing and the flywheel.

9. A reciprocating drive system comprising:

a reversible drive shaft;

a motor coupled to the reversible drive shaft for rotating the reversible drive shaft;

a reciprocating member, coupled to the reversible drive shaft through a mechanical coupling, for providing a reciprocating linear displacement;

a cam member coupled to the reversible drive shaft;

an eccentric member coupling the cam member to the reciprocating member; and an inertia-increasing member added to the reversible drive shaft that reduces the acceleration of the reversible drive shaft as the motor initiates the rotation of the drive shaft in one or more directions and adds to the service life of the mechanical coupling, wherein the cam member and eccentric member are configured to alter the reciprocating linear displacement of the reciprocating member upon reversal of the direction of rotation of the reversible drive shaft.

10. The reciprocating drive system of claim 9, wherein the cam member comprises a first stop member and a second stop member, and the eccentric member comprises a land member for abutting the stop members, wherein the reciprocating member has a first reciprocating linear displacement when the reversible drive shaft rotates the cam member in a first direction such that the first stop member abuts the land member, and the reciprocating member has a second reciprocating linear displacement when the reversible drive shaft rotates the cam member in a second direction such that the second stop member abuts the land member.

11. The reciprocating drive system of claim 9, further comprising a housing substantially containing the reciprocating drive system, wherein the inertia-increasing member comprises a flywheel having a shape configured to provide clearance between the flywheel and the housing.

12. The reciprocating drive system of claim 9, wherein the inertia-increasing member comprises a flywheel having a first recess attached to one end of the reversible drive shaft.

13. The reciprocating drive system of claim 12, further comprising a housing substantially containing the reciprocating drive system, wherein the flywheel has second recess for providing clearance between the flywheel and the housing.

14. The reciprocating drive system of claim 13, wherein the flywheel has a profile extending between the first recess and the second recess, wherein the profile is configured to provide clearance between the flywheel and the housing.

15. A method for reducing an impact force between components in a cylinder disengagement-type compressor comprising a block defining at least one cylinder, a reversible drive shaft rotatably supported by the block, a piston, coupled to the reversible drive shaft through a mechanical coupling, for compressing a fluid within the cylinder, a motor coupled to the reversible drive shaft for rotating the reversible drive shaft, a housing containing the block, the reversible drive shaft, the piston, and the motor, wherein the capacity of the cylinder disengagement-type compressor is changed upon reversal of the direction of rotation of the reversible drive shaft, the method comprising:

increasing the inertia of the reversible drive shaft by adding an inertia-increasing member to the reversible drive shaft; and selecting a mass and shape of the inertia-increasing member that reduces the acceleration of the reversible drive shaft upon start-up and reversal of the direction of rotation of the reversible drive shaft and adds to the service life of the mechanical coupling, while not degrading the service life of other components of the compressor below the extended service life of the mechanical coupling.

16. The method according to claim 15, wherein the mechanical coupling comprises a cam member on the drive shaft having a first stop member and a second stop member for creating a linear displacement of the piston within the cylinder, and an eccentric member having a land member for abutting the stop members, the eccentric member being coupled to the cam member for altering the linear displacement of the piston within the cylinder, wherein the cylinder disengagement-type compressor has a first capacity when the reversible drive shaft rotates the cam member in a first direction such that the first stop member abuts the land member, and the modulating compressor has a second capacity when the reversible drive shaft rotates the cam member in a second direction such that the second stop member abuts the land member.

17. The method of claim 16, wherein the inertia-increasing member is a flywheel fixed to the reversible drive shaft.

18. The method of claim 17, wherein the flywheel is fixed to an end of the reversible drive shaft.

19. The method of claim 16, wherein the inertia-increasing member comprises a flywheel configured to provide clearance between the flywheel and the housing.

20. The method of claim 19, wherein the cylinder disengagement-type compressor further comprises compressor mounts fixing the compressor block to the housing, wherein the size and shape the flywheel are selected to provide approximately equal service lives of the compressor mounts and the mechanical coupling.

21. A method for selecting the mass of an inertia-increasing member for reducing an impact force between components in a cylinder disengagement-type comprising a block defining at least one cylinder, a reversible drive shaft rotatably supported by the block, a piston, coupled to the reversible drive shaft through a mechanical coupling, for compressing a fluid within the cylinder, a motor coupled to the reversible drive shaft for rotating the reversible drive shaft, a housing substantially containing the cylinder disengagement-type compressor and fixed to the block via at least one compressor mount, wherein the capacity of the cylinder disengagement-type compressor is changed upon reversal of the direction of rotation of the reversible drive shaft, the method comprising:

(a) selecting a prototype inertia-increasing member having a mass and a configuration that provides clearance between the inertia-increasing member and the housing;

(b) placing the prototype inertia-increasing member on the reversible drive shaft;

(c) operating the compressor in a manner which repeatedly reverses the direction of rotation of the reversible drive shaft to determine the relative wear of the drive shaft and the compressor mounts; and (d) optimizing the size and shape of the inertia-increasing member so that the use of the inertia-increasing member will provide a compressor with an extended service life.

22. The method of claim 21, further comprising:

the step of decreasing the mass of the inertia-increasing member if at least one of the compressor mounts fails prematurely.

23. The method of claim 22, further comprising the step of increasing the mass of the inertia-increasing member if the reversible drive shaft fails prematurely.

24. The method of claim 21, wherein the size and shape of the inertia-increasing member is selected so that the service life of both the compressor mounts and the mechanical coupling fall within acceptable limits.

25. The method of claim 21, wherein the size and shape of the inertia-increasing member is selected so that the service life of both the compressor mounts and the mechanical coupling are approximately equal.

* * * * *

UNITED STATES PATENT AND TRADEMARK OFFICE

CERTIFICATE OF CORRECTION

PATENT NO. : 6,609,896 B2
DATED : August 26, 2003
INVENTOR(S) : Scott G. Hix et al.

It is certified that error appears in the above-identified patent and that said Letters Patent is hereby corrected as shown below:

Column 11,
Line 38, after "the size and shape" insert -- of --; and
Line 43, after "disengagement-type" insert -- compressor --.

Signed and Sealed this

Fourteenth Day of October, 2003

JAMES E. ROGAN
*Director of the United States Patent and Trademark Office*